US011696665B2

(12) United States Patent
Skeens et al.

(10) Patent No.: US 11,696,665 B2
(45) Date of Patent: Jul. 11, 2023

(54) TOUCHLESS CLEANING ASSEMBLY

(71) Applicants: Johnny Skeens, Louisville, TN (US); Donald Stock, Louisville, TN (US); Riley Skeens, Louisville, TN (US)

(72) Inventors: Johnny Skeens, Louisville, TN (US); Donald Stock, Louisville, TN (US); Riley Skeens, Louisville, TN (US)

( * ) Notice: Subject to any disclaimer, the term of this patent is extended or adjusted under 35 U.S.C. 154(b) by 247 days.

(21) Appl. No.: 17/241,266

(22) Filed: Apr. 27, 2021

(65) Prior Publication Data

US 2022/0338688 A1 Oct. 27, 2022

(51) Int. Cl.

| | |
|---|---|
| ***A47L 7/00*** | (2006.01) |
| ***B08B 5/02*** | (2006.01) |
| ***B08B 5/04*** | (2006.01) |
| ***B08B 13/00*** | (2006.01) |
| ***B08B 3/14*** | (2006.01) |
| ***A47L 9/24*** | (2006.01) |
| ***A47L 9/28*** | (2006.01) |
| ***A47L 5/14*** | (2006.01) |
| ***A47B 81/02*** | (2006.01) |
| ***B05B 12/08*** | (2006.01) |
| ***B05B 15/656*** | (2018.01) |
| ***B65H 75/44*** | (2006.01) |
| ***B65H 75/14*** | (2006.01) |
| ***B08B 3/02*** | (2006.01) |
| ***A47L 5/38*** | (2006.01) |

(52) U.S. Cl.

CPC ..... *A47L 7/0004* (2013.01); *A47B 81/02* (2013.01); *A47L 5/14* (2013.01); *A47L 9/24* (2013.01); *A47L 9/2857* (2013.01); *A47L 9/2868* (2013.01); *B05B 12/087* (2013.01); *B05B 15/656* (2018.02); *B08B 3/02* (2013.01); *B08B 3/14* (2013.01); *B08B 5/02* (2013.01); *B08B 5/04* (2013.01); *B08B 13/00* (2013.01); *B65H 75/14* (2013.01); *B65H 75/4471* (2013.01); *B65H 75/4478* (2013.01); *A47L 5/38* (2013.01); *B08B 2203/0276* (2013.01)

(58) Field of Classification Search

CPC ..... A47L 5/38; A47L 7/0004–0042

See application file for complete search history.

(56) References Cited

U.S. PATENT DOCUMENTS

| | | | |
|---|---|---|---|
| 3,381,312 | A | 5/1968 | Whitla |
| 3,742,520 | A | 7/1973 | Bernardi |
| 3,747,129 | A | 7/1973 | Dyar |
| 3,810,787 | A | 5/1974 | Yoeli |
| 3,969,133 | A | 7/1976 | McTighe |
| 4,345,343 | A | 8/1982 | Shipman |

(Continued)

*Primary Examiner* — Andrew A Horton

(57) ABSTRACT

A touchless cleaning assembly for cleaning a room in a touch-less manner includes a cabinet is recessed into a wall of a room. A plurality of hose reels is positioned in the cabinet and each of the hose reels includes a hose that is drawable outwardly from the cabinet for spraying a fluid for cleaning surfaces in the room, for blowing air to dry the surfaces and to vacuum the surfaces. An air compressor is positioned within the cabinet to direct compressed air into a respective hose reel to dry the surfaces. A vacuum is positioned within the cabinet to supply vacuum pressure to the a respective hose reel for suctionally removing the fluid from a floor of the room.

7 Claims, 5 Drawing Sheets

(56) References Cited

U.S. PATENT DOCUMENTS

| | | | | |
|---|---|---|---|---|
| 4,580,309 | A * | 4/1986 | Ogden | A47L 11/34 15/422.2 |
| 5,065,462 | A | 11/1991 | Romano | |
| 6,789,552 | B1 | 9/2004 | Robinson | |
| 2020/0217057 | A1 | 7/2020 | Spiro | |

* cited by examiner

TOUCHLESS CLEANING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cleaning devices and more particularly pertains to a new cleaning device for cleaning a room in a touch-less manner. The device includes a cabinet that is recessed into a wall and a plurality of hose reels in the cabinet. Additionally, an air compressor and a vacuum are positioned in the cabinet. Each of the hose reels can respectively spray fluid over the room, blow air to dry the fluid from the room, and suctionally remove the fluid from a floor of the room. In this way the room can be cleaned in a touch-less manner.

(2) Description of Related Art Including Information Disclosed Under 37 CFR 1.97 and 1.98

The prior art relates to cleaning devices including a variety of cleaning devices that are integrated into walls of a bathroom for spraying the bathroom with a cleaning solution. The prior art discloses a wall mounted cleaning device that includes a pressure washer and a spray wand for cleaning a room. The prior art discloses a spray gun that is fluidly connected to a pressurized fluid source for spraying a pressurized fluid onto surfaces for cleaning.

BRIEF SUMMARY OF THE INVENTION

An embodiment of the disclosure meets the needs presented above by generally comprising a cabinet is recessed into a wall of a room. A plurality of hose reels is positioned in the cabinet and each of the hose reels includes a hose that is drawable outwardly from the cabinet for spraying a fluid for cleaning surfaces in the room, for blowing air to dry the surfaces and to vacuum the surfaces. An air compressor is positioned within the cabinet to direct compressed air into a respective hose reel to dry the surfaces. A vacuum is positioned within the cabinet to supply vacuum pressure to the respective hose reel for suctionally removing the fluid from a floor of the room.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
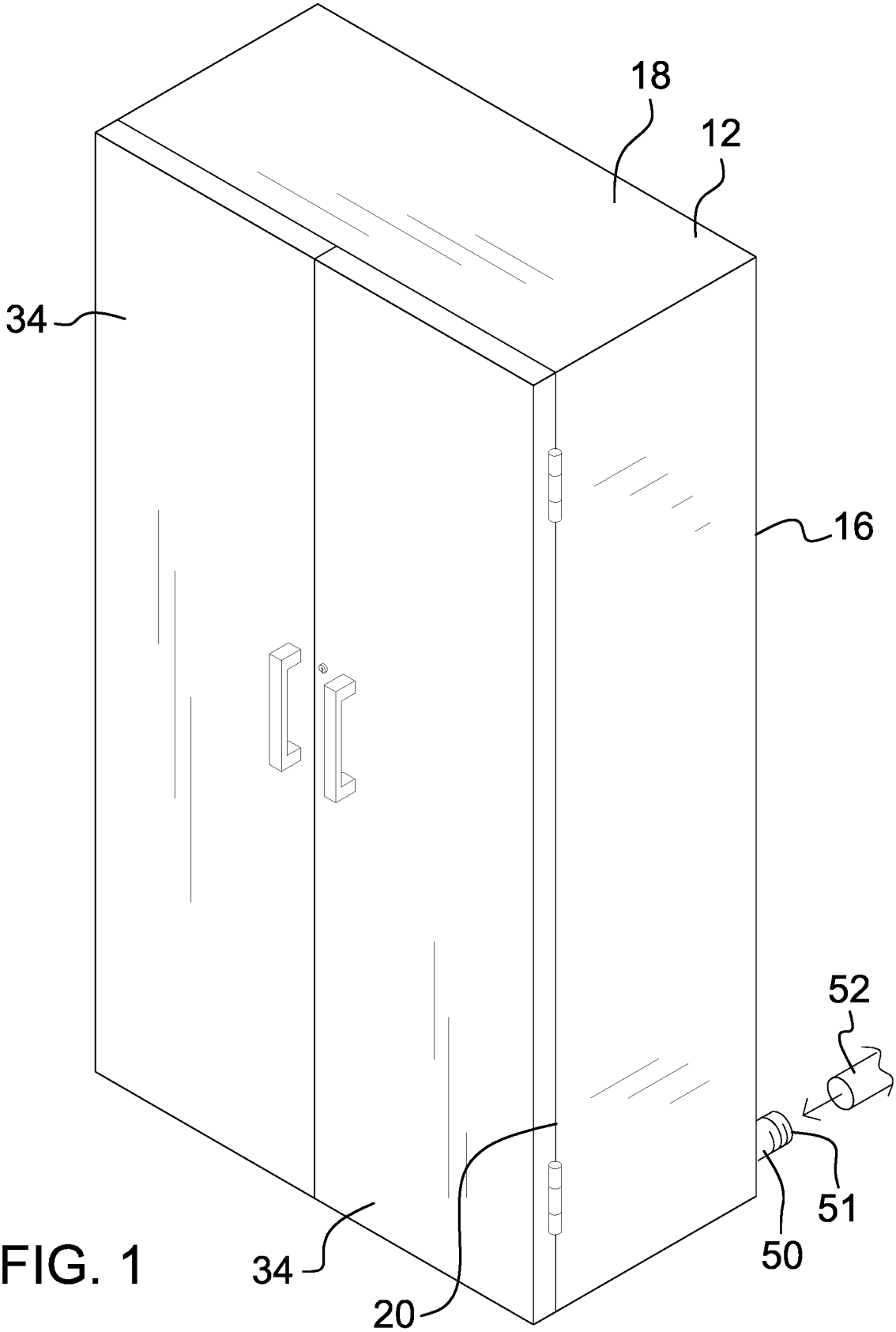
FIG. 1 is a front perspective view of a touchless cleaning assembly according to an embodiment of the disclosure.
Figure 2:
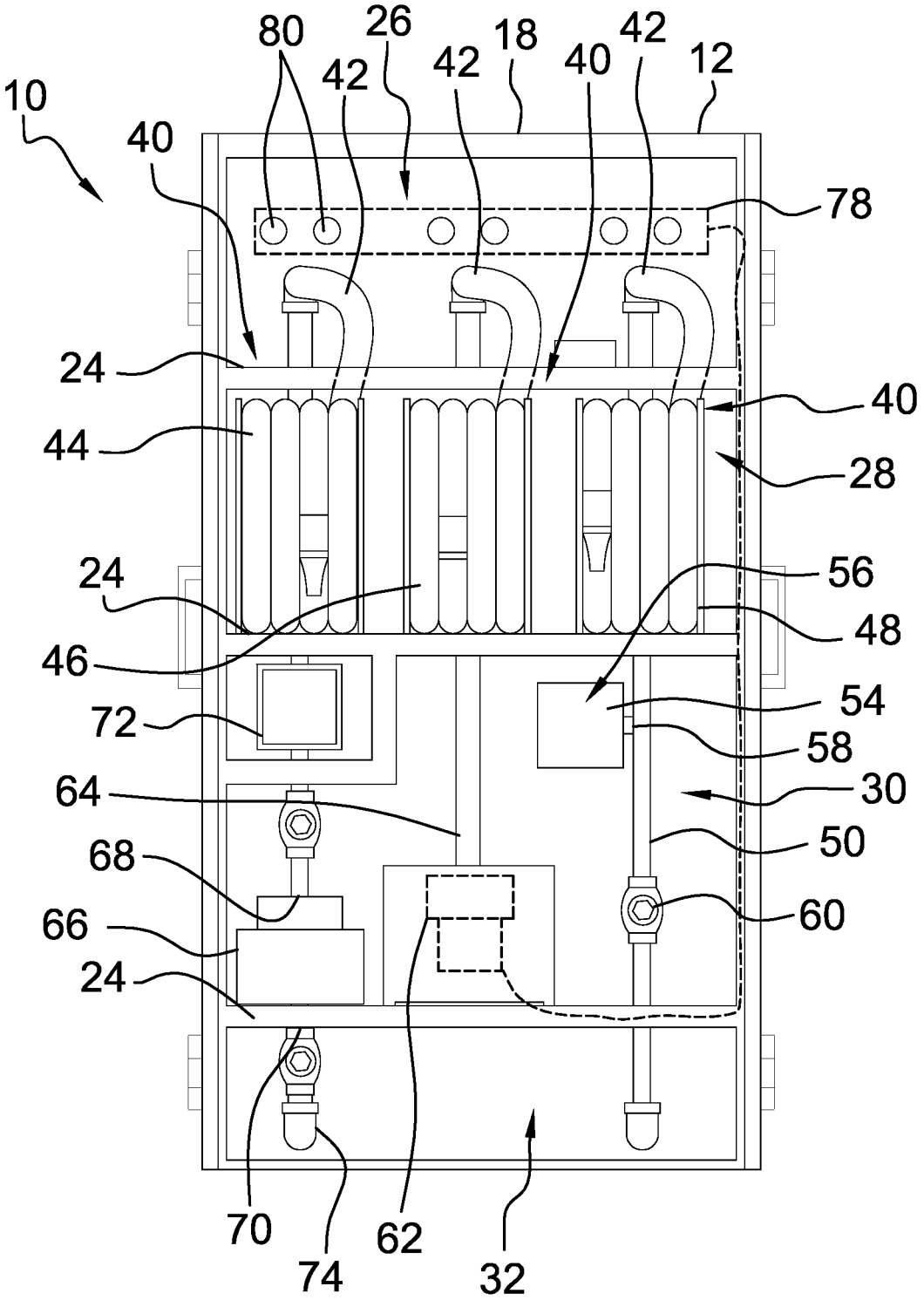
FIG. 2 is a front view of an embodiment of the disclosure.
Figure 3:
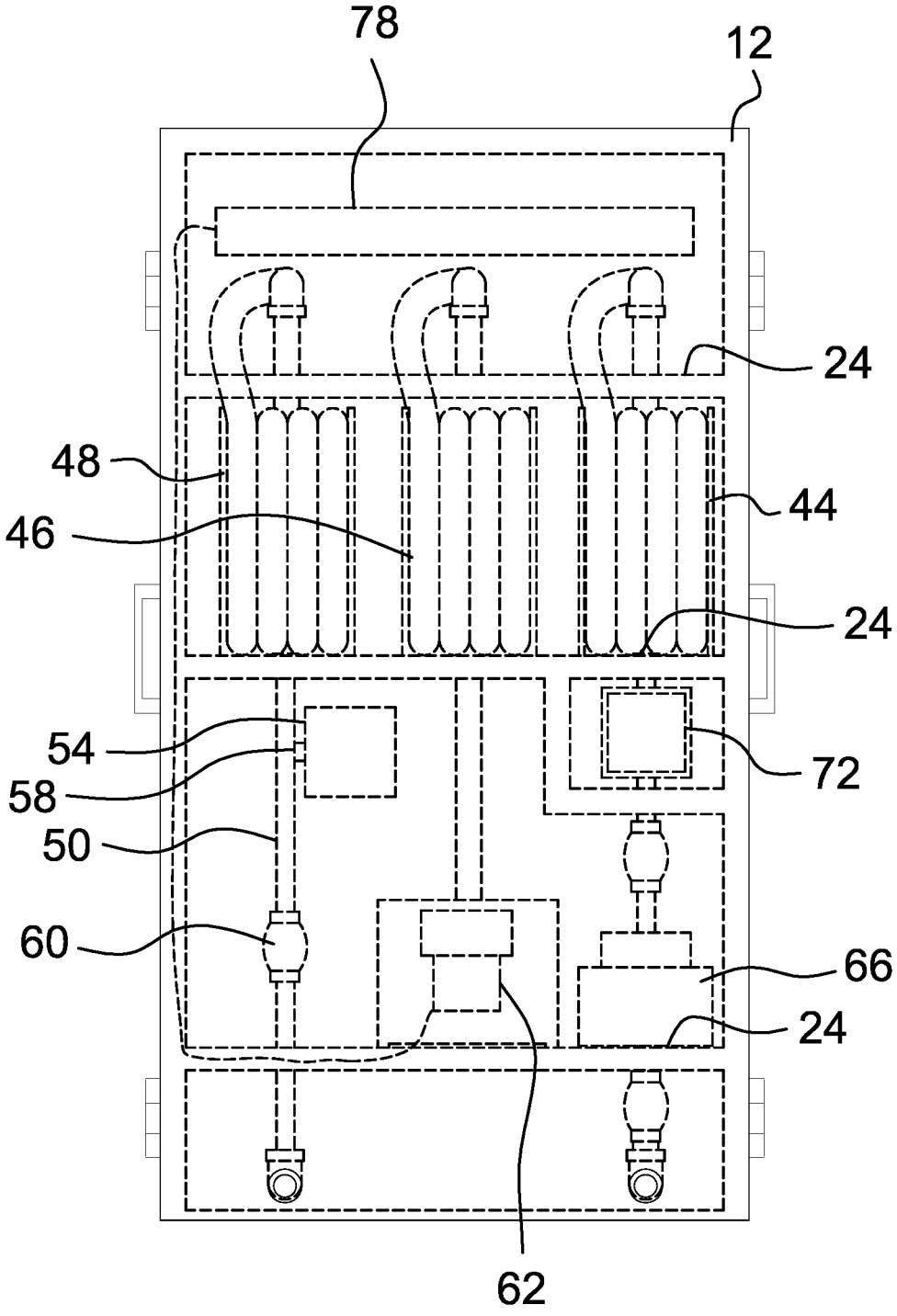
FIG. 3 is a back phantom view of an embodiment of the disclosure.
Figure 4:
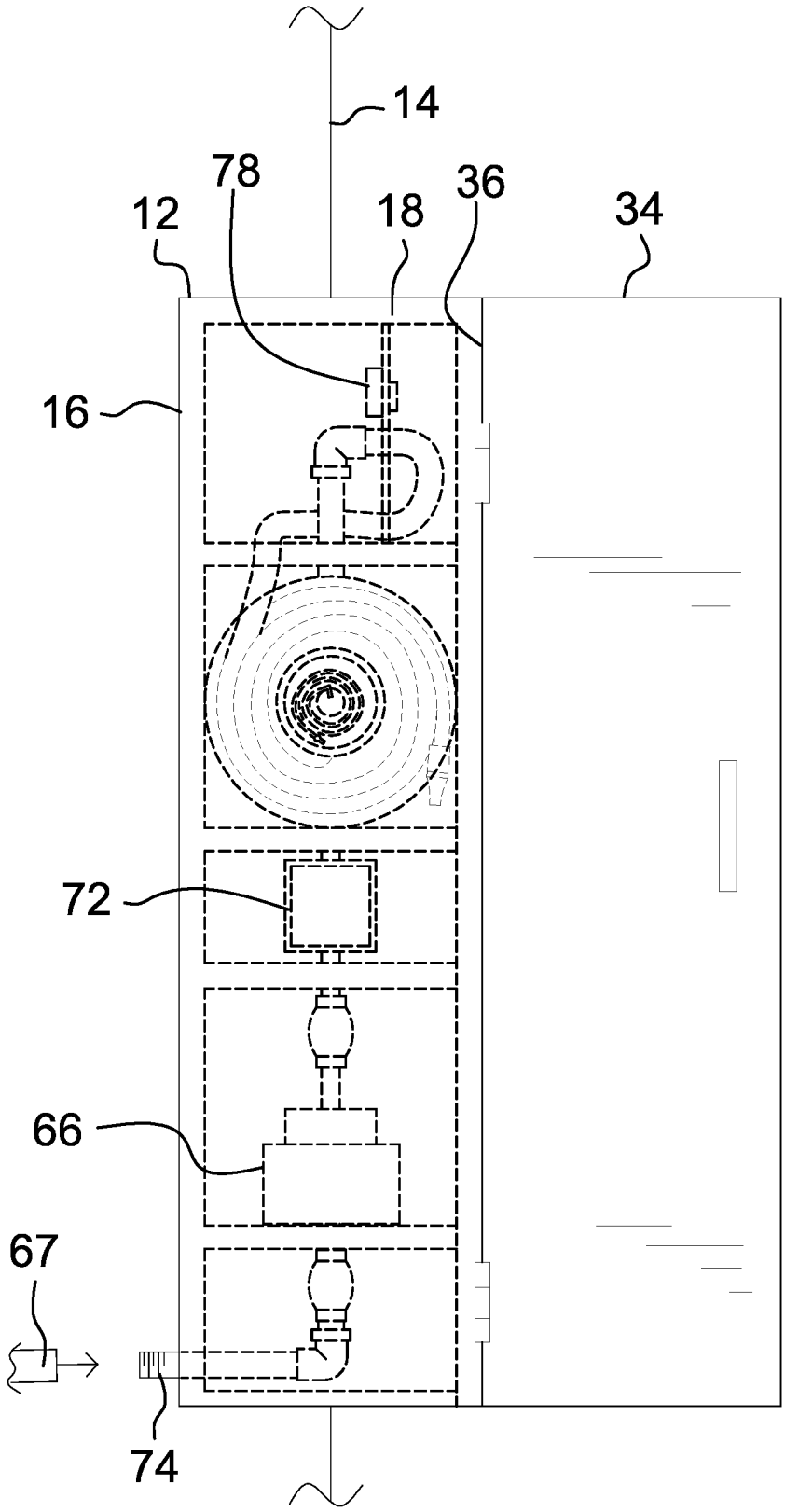
FIG. 4 is a right side phantom view of an embodiment of the disclosure.
Figure 5:
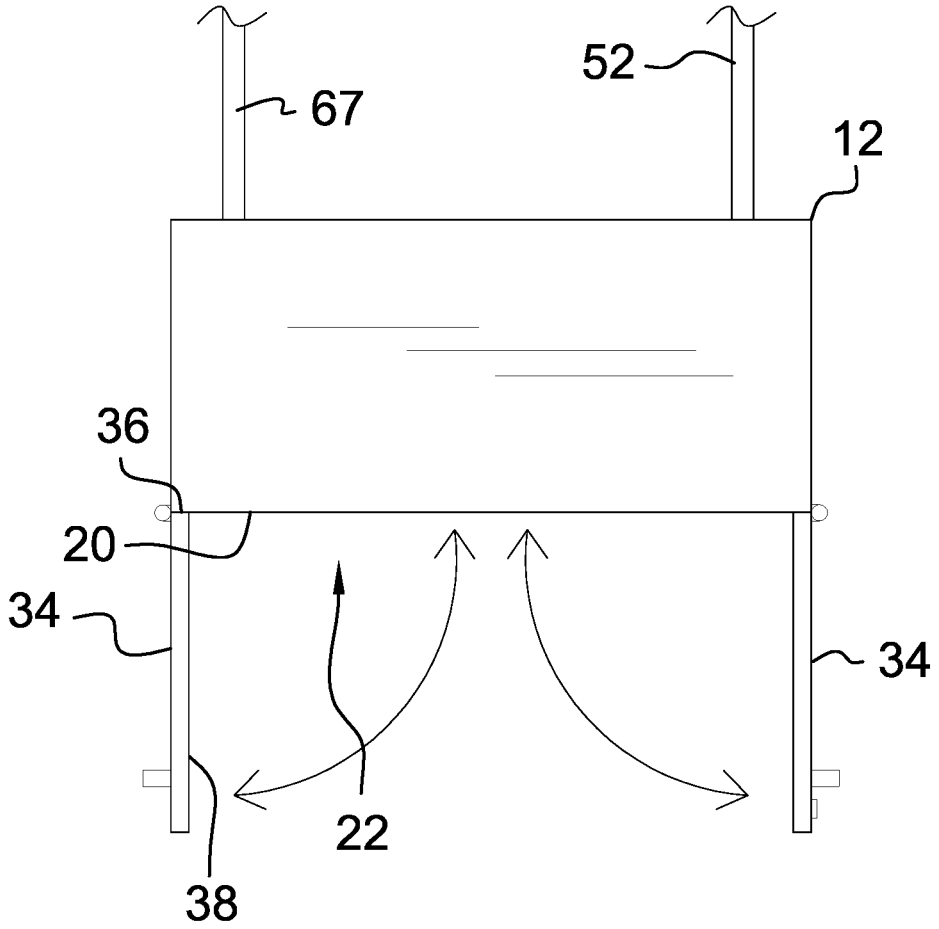
FIG. 5 is a top side view of an embodiment of the disclosure.

With reference now to the drawings, and in particular to FIGS. 1 through 5 thereof, a new cleaning device embodying the principles and concepts of an embodiment of the disclosure and generally designated by the reference numeral 10 will be described.

As best illustrated in FIGS. 1 through 5, the touchless cleaning assembly 10 generally comprises a cabinet 12 is recessed into a wall 14 of a room. The room may be a bathroom, break-room or other type of room that has only hard surfaces. The cabinet 12 has a rear wall 16 and an outer wall 18 extending forwardly therefrom, and the outer wall 18 has a distal edge 20 defining an opening 22 into the cabinet 12. The cabinet 12 has a plurality of shelves 24 each being integrated into the cabinet 12, and the shelves 24 are spaced apart from each other and are vertically distributed in the cabinet 12. The shelves 24 define an electronics space 26, a reel space 28, an equipment space 30 and a pipe space 32. A pair of doors 34 is each hingedly coupled to the cabinet 12 for opening 22 and closing the cabinet 12. Each of the doors 34 has a first edge 36 and a first surface 38, and the first edge 36 of each of the doors 34 is hingedly coupled to the distal edge 20 of the outer wall 18 of the cabinet 12. The first surface 38 of each of the doors 34 lies against the distal edge 20 when the doors 34 are closed.

A plurality of hose reels 40 is each positioned in the cabinet 12 and each of the hose reels 40 includes a hose 42 that is drawable outwardly from the cabinet 12. Each of the hose reels 40 is biased to retract the hose 42 associated with each of the hose reels 40 for storage and each of the hose reels 40 is positioned in the reel space 28. The plurality of hose reels 40 includes a vacuum reel 44, an air reel 46 and a spray reel 48. The hose 42 associated with the spray reel 48 is drawable outwardly from the cabinet 12 for spraying a fluid for cleaning surfaces in the room. The hose 42 associated with the air reel 46 is drawable outwardly from the cabinet 12 for blowing air to dry the surfaces. Additionally, the hose 42 associated with the vacuum reel 44 is drawable outwardly from the cabinet 12 to vacuum 66 the surfaces.

A fluid supply line 50 is fluidly coupled to the spray reel 48 and the fluid supply line 50 is fluidly coupled to a fluid source 52 to direct a pressurized fluid 49 into the spray reel 48. In this way the hose 42 associated with the spray reel 48 can spray the fluid 49 onto the surfaces in the room for cleaning. The fluid supply line 50 extends outwardly through the rear wall 16 of the cabinet 12. The fluid supply line 50 has a distal end 51 with respect to the cabinet 12 such that the distal end 51 can be fluidly coupled to the fluid source 52. The hose 42 associated with the spray reel 48 may include a spray nozzle that has a fluid valve for turning the flow of fluid 49 on and off.

A solution tank 54 is positioned within the cabinet 12 and the solution tank 54 contains a cleaning solution 56. The solution tank 54 is in fluid communication with the fluid supply line 50 to release the cleaning solution 56 into the fluid 49 that is directed into the spray reel 48. The solution tank 54 has an output port 58 and the output port 58 is fluidly coupled to the fluid supply line 50. The solution tank 54 is positioned in the equipment space 30 in the cabinet 12 and the cleaning solution 56 may comprise a detergent, a sanitizer or any other cleaning solution 56 that might commonly be employed in an institutional environment. A spray check valve 60 is fluidly coupled to the fluid supply line 50 and the spray check valve 60 has a single flow direction. In this way the spray check valve 60 inhibits fluid 49 from flowing from the spray reel 48 into the fluid supply. The spray check valve 60 is positioned in the pipe space 32 and the spray check valve 60 may be a fluid check valve or the like. Additionally, the cleaning solution 56 can be sprayed from the hose 42 associated with the spray reel 48 without being mixed with the fluid 49 for sanitizing the room.

An air compressor 62 is positioned within the cabinet 12 and the air compressor 62 is fluidly coupled to the hose 42 associated with the air reel 46 to supply compressed air to the hose 42 associated with the air reel 46. In this way the hose 42 associated with the air reel 46 can be employed for directing the compressed air onto the surfaces in the room to dry the surfaces. The air compressor 62 is positioned in the equipment space 30, the air compressor 62 has an outlet 64 and the outlet 64 of the air compressor 62 is fluidly coupled to the hose 42 associated with the air reel 46. The air compressor 62 may be an electric air compressor with a maximum operational pressure of approximately 200.0 psi.

A vacuum 66 is positioned within the cabinet 12 and the vacuum 66 is fluidly coupled to the hose 42 associated with the vacuum reel 44 to supply vacuum pressure to the hose 42 associated with the vacuum reel 44. In this way the hose 42 associated with the vacuum reel 44 can be employed for suctionally removing the fluid 49 from a floor of the room. The vacuum 66 is in fluid communication with a sewer line 67 to direct the fluid into the sewer line 67. The vacuum 66 is positioned in the equipment space 30, and the vacuum 66 has an intake 68 and an exhaust 70. The intake 68 is fluidly coupled to the hose 42 associated with the vacuum reel 44 to deliver the fluid 49 outwardly through the exhaust 70. A strainer 72 is positioned within the cabinet 12 and the strainer 72 is fluidly coupled between the intake 68 of the vacuum 66 and the hose 42 associated with the vacuum reel 44. In this way the fluid 49 can pass through the strainer 72. Moreover, the strainer 72 is comprised of a fluid permeable material such that the strainer 72 can filter debris from the fluid 49.

A fluid dump line 74 is fluidly coupled to the vacuum 66 to receive the fluid 49 from the hose 42 associated with the vacuum reel 44. Additionally, the fluid dump line 74 is fluidly coupled between the exhaust 70 of the vacuum 66 and the sewer line 67. A vacuum check valve 76 is fluidly coupled to the fluid dump line 74. The vacuum check valve 76 has a single flow direction to inhibit fluid 49 from flowing into the vacuum 66 from the sewer line 67. Additionally, the vacuum check valve 76 is positioned in the pipe space 32 and the vacuum check valve 76 may be a fluid check valve or the like.

A control panel 78 is positioned within the cabinet 12 and the control panel 78 is in communication with the air compressor 62 and the vacuum 66 for turning the air compressor 62 and the vacuum 66 on and off. The control panel 78 is positioned in the electronics space 26 and the control panel 78 includes a plurality of control buttons 80 each movably integrated into the control panel 78 such that each of the control buttons 80 can be manipulated. Each of the control buttons 80 controls respective operational parameters of a respective air compressor 62 and vacuum 66. A power cord 82 is coupled to and extends away from the cabinet 12 and the power cord 82 is electrically coupled to the control panel 78. The power cord 82 has a distal end 84 with respect to the cabinet 12 and the distal end 84 is electrically coupled to a power source 86 comprising an electrical system of the building in which the room is situated.

In use, the doors 34 on the cabinet 12 are opened and the hose 42 associated with the spray reel 48 is drawn out to spray the room down with the fluid 49 and the cleaning solution 56. The spray reel 48 is allowed to retract and the hose 42 associated with the air reel 46 is drawn outwardly from the cabinet 12. The air compressor 62 is turned on and the hose 42 associated with the air reel 46 is employed to direct the compressed air onto sinks, countertops and other surfaces to blow the fluid 49 and the cleaning solution 56 onto the floor of the room. The air reel 46 is allowed to retract and the air compressor 62 is turned off. The hose 42 associated with the vacuum reel 44 is drawn outwardly from the cabinet 12 and the vacuum 66 is turned on. In this way the fluid 49 and cleaning solution 56 on the floor can be suctionally removed to be sent into the sewer line 67. In this way the room can be cleaned and sanitized in a touch-less manner thereby enhancing cleanliness and sanitation of the room.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A touchless cleaning assembly for cleaning a room in a touchless manner, said assembly comprising:

a cabinet being recessed into a wall of the room;

a pair of doors, each of said doors being hingedly coupled to said cabinet for opening and closing said cabinet;

a plurality of hose reels, each of said hose reels being positioned in said cabinet, each of said hose reels including a hose being drawable outwardly from said cabinet, each of said hose reels being biased to retract said hose associated with each of said hose reels for storage, each of said hose reels being positioned in a reel space, said plurality of hose reels including a vacuum reel, an air reel and a spray reel, said hose associated with said spray reel being drawable outwardly from said cabinet for spraying a fluid for cleaning surfaces in the room, said hose associated with said air reel being drawable outwardly from said cabinet for blowing air to dry the surfaces, said hose associated with said vacuum reel being drawable outwardly from said cabinet to vacuum the surfaces;

a fluid supply line being fluidly coupled to said spray reel, said fluid supply line being fluidly coupled to a fluid source wherein said fluid supply line is configured to direct a pressurized fluid into said spray reel thereby facilitating said hose associated with said spray reel to spray the fluid onto the surfaces in the room for cleaning;

a solution tank being positioned within said cabinet wherein said solution tank is configured to contain a cleaning solution, said solution tank being in fluid communication with said fluid supply line wherein said solution tank is configured to release the cleaning solution in the fluid being directed into said spray reel;

an air compressor being positioned within said cabinet, said air compressor being fluidly coupled to said hose associated with said air reel wherein said air compressor is configured to supply compressed air to said hose associated with said air reel for directing the compressed air onto the surfaces in the room to dry the surfaces;

a vacuum being positioned within said cabinet, said vacuum being fluidly coupled to said hose associated with said vacuum reel wherein said vacuum is configured to supply vacuum pressure to said hose associated with said vacuum reel for suctionally removing the fluid from a floor of the room, said vacuum being in fluid communication with a sewer line wherein said vacuum is configured to direct the fluid into the sewer line;

a fluid dump line being fluidly coupled to said vacuum wherein said fluid dump line is configured to receive the fluid from said hose associated with said vacuum reel, said fluid dump line being fluidly coupled between said exhaust of said vacuum and the sewer line;

a control panel being positioned within said cabinet, said control panel being in communication with said air compressor and said vacuum for turning said air compressor and said vacuum on and off.

2. The assembly according to claim 1, wherein:

said cabinet has a rear wall and an outer wall extending forwardly therefrom, said outer wall having a distal edge defining an opening into said cabinet, said cabinet having a plurality of shelves each being integrated into said cabinet, said shelves being spaced apart from each other and being vertically distributed in said cabinet, said shelves defining an electronics space, a reel space, an equipment space and a pipe space;

said fluid supply line extends outwardly through said rear wall of said cabinet, said fluid supply line having a distal end with respect to said cabinet wherein said distal end is configured to be fluidly coupled to the fluid source;

said solution tank has an output port, said output port being fluidly coupled to said fluid supply line, said solution tank being positioned in said equipment space in said cabinet;

said air compressor is positioned in said equipment space, said air compressor having an outlet, said outlet of said air compressor being fluidly coupled to said hose associated with said air reel; and said vacuum being positioned in said equipment space, said vacuum having an intake and an exhaust, said intake being fluidly coupled to said hose associated with said vacuum reel wherein said vacuum is configured to deliver the fluid outwardly through said exhaust.

3. The assembly according to claim 2, further comprising a spray check valve being fluidly coupled to said fluid supply line, said spray check valve having a single flow direction wherein said spray check valve is configured to inhibit fluid from flowing from said spray reel into the fluid supply, said spray check valve being positioned in said pipe space.

4. The assembly according to claim 2, further comprising a vacuum check valve being fluidly coupled to said fluid dump line, said vacuum check valve having a single flow direction wherein said vacuum check valve is configured to inhibit fluid from flowing into said vacuum from the sewer line, said vacuum check valve being positioned in said pipe space.

5. The assembly according to claim 2, further comprising a strainer being positioned within said cabinet, said strainer being fluidly coupled between said intake of said vacuum and said hose associated with said vacuum reel wherein said strainer is configured to have the fluid pass through said strainer, said strainer being comprised of a fluid permeable material wherein said strainer is configured to filter debris from the fluid.

6. The assembly according to claim 2, wherein:

said control panel is positioned in said electronics space, said control panel including a plurality of control buttons each being movably integrated into said control panel wherein each of said control buttons is configured to be manipulated, each of said control buttons controlling respective operational parameters of a respective air compressor and vacuum; and a power cord being coupled to and extending away from said cabinet, said power cord being electrically coupled to said control panel, said power cord having a distal end with respect to said cabinet wherein said distal end is configured to be electrically coupled to a power source comprising an electrical system of the building in which the room is situated.

7. A touchless cleaning assembly for cleaning a room in a touchless manner, said assembly comprising:

a cabinet being recessed into a wall of a room, said cabinet having a rear wall and an outer wall extending forwardly therefrom, said outer wall having a distal edge defining an opening into said cabinet, said cabinet having a plurality of shelves each being integrated into said cabinet, said shelves being spaced apart from each other and being vertically distributed in said cabinet, said shelves defining an electronics space, a reel space, an equipment space and a pipe space;

a pair of doors, each of said doors being hingedly coupled to said cabinet for opening and closing said cabinet, each of said doors having a first edge and a first surface, said first edge of each of said doors being hingedly coupled to said distal edge of said outer wall of said cabinet, said first surface of each of said doors lying against said distal edge when said doors are closed;

a plurality of hose reels, each of said hose reels being positioned in said cabinet, each of said hose reels including a hose being drawable outwardly from said cabinet, each of said hose reels being biased to retract said hose associated with each of said hose reels for storage, each of said hose reels being positioned in said reel space, said plurality of hose reels including a vacuum reel, an air reel and a spray reel, said hose associated with said spray reel being drawable outwardly from said cabinet for spraying a fluid for cleaning surfaces in the room, said hose associated with said air reel being drawable outwardly from said cabinet for blowing air to dry the surfaces, said hose associated with said vacuum reel being drawable outwardly from said cabinet to vacuum the surfaces;

a fluid supply line being fluidly coupled to said spray reel, said fluid supply line being fluidly coupled to a fluid source wherein said fluid supply line is configured to direct a pressurized fluid into said spray reel thereby facilitating said hose associated with said spray reel to spray the fluid onto the surfaces in the room for cleaning, said fluid supply line extending outwardly through said rear wall of said cabinet, said fluid supply line having a distal end with respect to said cabinet wherein said distal end is configured to be fluidly coupled to the fluid source;

a solution tank being positioned within said cabinet wherein said solution tank is configured to contain a cleaning solution, said solution tank being in fluid communication with said fluid supply line wherein said solution tank is configured to release the cleaning solution in the fluid being directed into said spray reel, said solution tank having an output port, said output port being fluidly coupled to said fluid supply line, said solution tank being positioned in said equipment space in said cabinet;

a spray check valve being fluidly coupled to said fluid supply line, said spray check valve having a single flow direction wherein said spray check valve is configured to inhibit fluid from flowing from said spray reel into the fluid supply, said spray check valve being positioned in said pipe space;

an air compressor being positioned within said cabinet, said air compressor being fluidly coupled to said hose associated with said air reel wherein said air compressor is configured to supply compressed air to said hose associated with said air reel for directing the compressed air onto the surfaces in the room to dry the surfaces, said air compressor being positioned in said equipment space, said air compressor having an outlet, said outlet of said air compressor being fluidly coupled to said hose associated with said air reel;

a vacuum being positioned within said cabinet, said vacuum being fluidly coupled to said hose associated with said vacuum reel wherein said vacuum is configured to supply vacuum pressure to said hose associated with said vacuum reel for suctionally removing the fluid from a floor of the room, said vacuum being in fluid communication with a sewer line wherein said vacuum is configured to direct the fluid into the sewer line, said vacuum being positioned in said equipment space, said vacuum having an intake and an exhaust, said intake being fluidly coupled to said hose associated with said vacuum reel wherein said vacuum is configured to deliver the fluid outwardly through said exhaust;

a strainer being positioned within said cabinet, said strainer being fluidly coupled between said intake of said vacuum and said hose associated with said vacuum reel wherein said strainer is configured to have the fluid pass through said strainer, said strainer being comprised of a fluid permeable material wherein said strainer is configured to filter debris from the fluid;

a fluid dump line being fluidly coupled to said vacuum wherein said fluid dump line is configured to receive the fluid from said hose associated with said vacuum reel, said fluid dump line being fluidly coupled between said exhaust of said vacuum and the sewer line;

a vacuum check valve being fluidly coupled to said fluid dump line, said vacuum check valve having a single flow direction wherein said vacuum check valve is configured to inhibit fluid from flowing into said vacuum from the sewer line, said vacuum check valve being positioned in said pipe space;

a control panel being positioned within said cabinet, said control panel being in communication with said air compressor and said vacuum for turning said air compressor and said vacuum on and off, said control panel being positioned in said electronics space, said control panel including a plurality of control buttons each being movably integrated into said control panel wherein each of said control buttons is configured to be manipulated, each of said control buttons controlling respective operational parameters of a respective air compressor and vacuum; and a power cord being coupled to and extending away from said cabinet, said power cord being electrically coupled to said control panel, said power cord having a distal end with respect to said cabinet wherein said distal end is configured to be electrically coupled to a power source comprising an electrical system of the building in which the room is situated.

* * * * *